US011053741B1

(12) United States Patent
Davis et al.

(10) Patent No.: US 11,053,741 B1
(45) Date of Patent: Jul. 6, 2021

(54) SIDETRACK ASSEMBLY WITH REPLACEMENT MILL HEAD FOR OPEN HOLE WHIPSTOCK

(71) Applicant: Weatherford Technology Holdings, LLC, Houston, TX (US)

(72) Inventors: Richard C. Davis, Houston, TX (US); Jeremy Lee Stone, Houston, TX (US); James H. Taylor, Jr., Houston, TX (US); William Allen Schultz, Jr., Cypress, TX (US); David W. Teale, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/894,577

(22) Filed: Jun. 5, 2020

(51) Int. Cl.

| | |
|---|---|
| ***E21B 10/43*** | (2006.01) |
| ***E21B 29/06*** | (2006.01) |
| ***E21B 29/00*** | (2006.01) |
| ***E21B 7/06*** | (2006.01) |

(52) U.S. Cl.
CPC ..... *E21B 10/43* (2013.01); *E21B 7/06* (2013.01); *E21B 7/061* (2013.01); *E21B 29/002* (2013.01); *E21B 29/06* (2013.01)

(58) Field of Classification Search
CPC ..... E21B 10/43; E21B 7/061; E21B 29/002; E21B 29/06
See application file for complete search history.

(56) References Cited

U.S. PATENT DOCUMENTS

| | | | | |
|---|---|---|---|---|
| 5,150,636 | A | 9/1992 | Hill | |
| 5,441,121 | A | 8/1995 | Tibbitts | |
| 5,806,596 | A | 9/1998 | Hardy et al. | |
| 6,364,037 | B1 * | 4/2002 | Brunnert | E21B 7/061 175/61 |
| 6,460,002 | B1 | 10/2002 | Bone et al. | |
| 6,695,056 | B2 | 2/2004 | Haugen et al. | |
| 7,343,988 | B2 * | 3/2008 | Jamieson | E21B 7/062 175/263 |
| 7,823,660 | B2 | 11/2010 | Giroux et al. | |
| 7,878,253 | B2 | 2/2011 | Stowe et al. | |
| 9,228,406 | B2 * | 1/2016 | Swadi | E21B 10/43 |
| 9,506,308 | B2 | 11/2016 | Vemuri | |

(Continued)

FOREIGN PATENT DOCUMENTS

WO 2016209686 12/2016

*Primary Examiner* — Yong-Suk (Philip) Ro
(74) *Attorney, Agent, or Firm* — Patterson + Sheridan, LLP

(57) ABSTRACT

A sidetrack assembly for forming a lateral wellbore includes a cutting device having a body having a passage, and a mill head configured to connect to the body so that an interior of the mill head and the body form a pressure chamber in fluid communication with the outlet passage. The mill head includes a first port in fluid communication with the pressure chamber, a second port in fluid communication with the pressure chamber, and a blade arranged on a face of the mill head. A whipstock connected to the cutting device includes a tubing having a first end removably inserted in the first port and the passage and a second end connectable to a downhole tool, an inclined surface for guiding the mill at a non-zero angle relative to a central axis of an existing wellbore, and an attachment section removably connecting the cutting device and the whipstock.

20 Claims, 10 Drawing Sheets

(56) References Cited

U.S. PATENT DOCUMENTS

| | | | | |
|---|---|---|---|---|
| 9,695,639 | B2 | 7/2017 | Vincent et al. | |
| 9,932,793 | B2 | 4/2018 | Lang et al. | |
| 9,995,106 | B2 | 6/2018 | Razvi et al. | |
| 10,557,325 | B2 * | 2/2020 | Korf | E21B 29/06 |
| 2002/0170713 | A1 | 11/2002 | Haugen et al. | |
| 2007/0289749 | A1 | 12/2007 | Wood et al. | |
| 2010/0224372 | A1 | 9/2010 | Stowe et al. | |
| 2012/0255785 | A1 | 10/2012 | Gregurek et al. | |
| 2013/0213654 | A1 | 8/2013 | Dewey et al. | |
| 2013/0319653 | A1 | 12/2013 | Ibragimov et al. | |
| 2015/0122495 | A1 | 5/2015 | Vincent et al. | |
| 2016/0258236 | A1 | 9/2016 | Vemuri | |
| 2016/0258237 | A1 | 9/2016 | Lang et al. | |
| 2017/0101838 | A1 | 4/2017 | Razvi et al. | |
| 2019/0003264 | A1 | 1/2019 | Swadi et al. | |
| 2019/0106940 | A1 | 4/2019 | Korf et al. | |
| 2020/0040683 | A1 | 2/2020 | Taylor, Jr. et al. | |

* cited by examiner

SIDETRACK ASSEMBLY WITH REPLACEMENT MILL HEAD FOR OPEN HOLE WHIPSTOCK

BACKGROUND

Field

Embodiments of the present disclosure relate to sidetrack drilling for hydrocarbons. In particular, this disclosure relates to a sidetrack assembly for creating a lateral wellbore from a parent wellbore. More particularly still, this disclosure relates to a sidetrack assembly for supplying cement and forming a lateral wellbore.

Description of the Related Art

In recent years, technology has been developed which allows an operator to drill a primary vertical well, and then continue drilling an angled lateral borehole off of that vertical well at a chosen depth. Generally, the vertical, or "parent" wellbore is first drilled and then supported with strings of casing. The strings of casing are cemented into the formation by the extrusion of cement into the annular regions between the strings of casing and the surrounding formation. The combination of cement and casing strengthens the wellbore and facilitates the isolation of certain areas of the formation behind the casing for the production of hydrocarbons.

A lateral wellbore can also be formed off of an open hole parent wellbore. Forming lateral or "sidetrack" wellbore, a tool known as a whipstock is positioned in the parent wellbore at the depth where deflection is desired, typically at or above one or more producing zones. The whipstock is set in place at the desired deflection depth. The whipstock is then used to divert milling bits into a side of the parent wellbore to create a pilot borehole in the parent wellbore. Thereafter, a drill bit is run into the parent wellbore. The drill bit is deflected against the whipstock, and urged through the pilot borehole. From there, the drill bit contacts the rock formation in order to form the new lateral hole in a desired direction. This process is sometimes referred to as sidetrack drilling.

When forming the lateral wellbore through the parent wellbore, an anchor is first set in the parent wellbore at a desired depth. The anchor is typically a packer having slips and seals. The anchor tool acts as a fixed body against which tools above it may be urged to activate different tool functions. The anchor tool typically has a key or other orientation-indicating member.

A whipstock is next run into the wellbore. The whipstock has a body that lands into or onto the anchor. A stinger is located at the bottom of the whipstock which engages the anchor device. At a top end of the body, the whipstock includes a deflection portion having a concave face. The stinger at the bottom of the whipstock body allows the concave face of the whipstock to be properly oriented so as to direct the milling operation. The deflection portion receives the milling bits as they are urged downhole. In this way, the respective milling bits are directed against the surrounding wellbore for forming the pilot borehole.

In order to form the pilot borehole, a milling bit, or "mill," is placed at the end of a string of drill pipe or other work string. In some milling operations, a series of mills is run into the hole. First, a starting mill is run into the hole. Rotation of the string with the starting mill rotates the mill, causing a portion of the wellbore to be removed. This mill is followed by other mills, which complete the pilot borehole or extend the lateral wellbore.

In some instances, prior to drilling the sidetrack, it may be desirable to isolate the formation below the whipstock. The formation may be isolated by supplying cement below the whipstock. This is generally at least a two trip process. A first trip to supply the cement, and a second trip to mill the sidetrack wellbore.

There is, therefore, a need for a sidetrack assembly with a mill that can perform a cementing operation and form at least a portion of a lateral wellbore in a single trip downhole.

SUMMARY

In one embodiment, a cutting device includes a body having a passage and a mill head configured to connect to the body so that an interior of the mill head and the body form a pressure chamber in fluid communication with the passage. The mill head includes a first port having a central axis aligned with a central axis of the outlet passage and in fluid communication with the pressure chamber, a second port in fluid communication with the pressure chamber, and a blade arranged on a face of the mill head.

In another embodiment described herein, a sidetrack assembly for forming a lateral wellbore, includes a cutting device having a body having a passage, and a mill head configured to connect to the body so that an interior of the mill head and the body form a pressure chamber in fluid communication with the outlet passage. The mill head includes a first port having a central axis aligned with a central axis of the outlet passage and in fluid communication with the pressure chamber, a second port in fluid communication with the pressure chamber, and at least one blade arranged on a face of the mill head. A whipstock is removably connected to the cutting device. The whipstock includes a tubing having a first end removably inserted in the first port and the passage and a second end connectable to a downhole tool, an inclined surface for guiding the mill at a non-zero angle relative to a central axis of an existing wellbore, and an attachment section providing a removable connection between the cutting device and the whipstock.

In another embodiment, a control system for controlling downhole operations includes a body having a passage, a tubing movably positioned in the passage and in fluid communication with the passage, and an auxiliary port extending from the passage. The tubing is moveable between a first position and a second position relative to the passage. In the first position, the auxiliary port is isolated from the passage so that fluid entering the passage bypasses the auxiliary port and is directed through the tubing to a first downhole location for a first desired operation. In the second position, the auxiliary port is in fluid communication with the passage so that fluid entering the passage is directed through the tubing to the first downhole location for the first desired operation and through the auxiliary port to a second downhole location for a second desired operation.

BRIEF DESCRIPTION OF THE DRAWINGS

So that the manner in which the above recited features of the present disclosure are attained and can be understood in detail, a more particular description of the disclosure, briefly summarized above, may be had by reference to the drawings that follow. The drawings illustrate only selected embodiments of this disclosure, and are not to be considered limiting of its scope.

DETAILED DESCRIPTION OF THE PREFERRED EMBODIMENT

Figure 1:
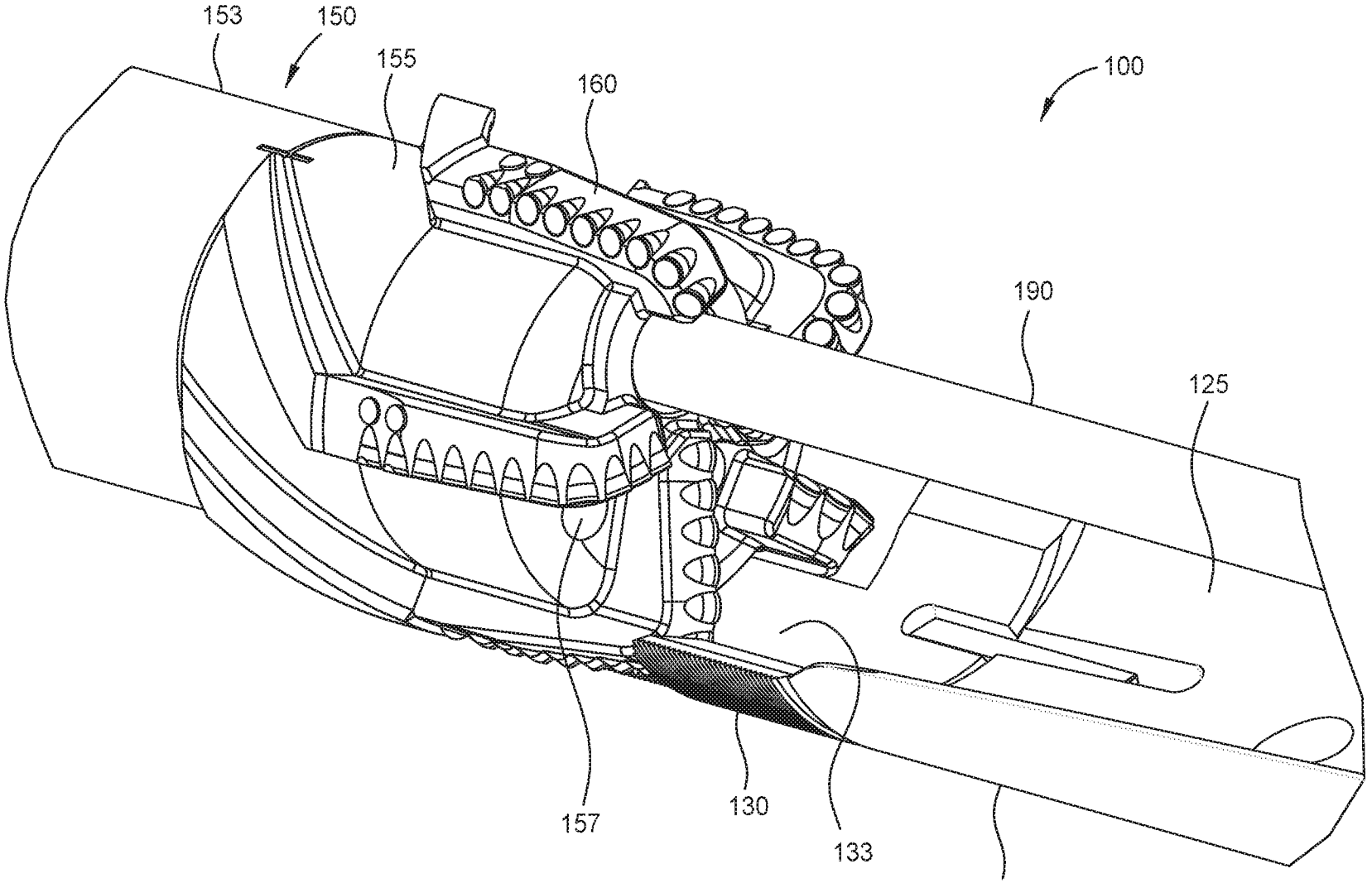
FIG. 1 is a perspective view of a portion of one embodiment of a sidetrack assembly for supplying cement and milling at least portion of a lateral wellbore in a wellbore.
Figure 2:
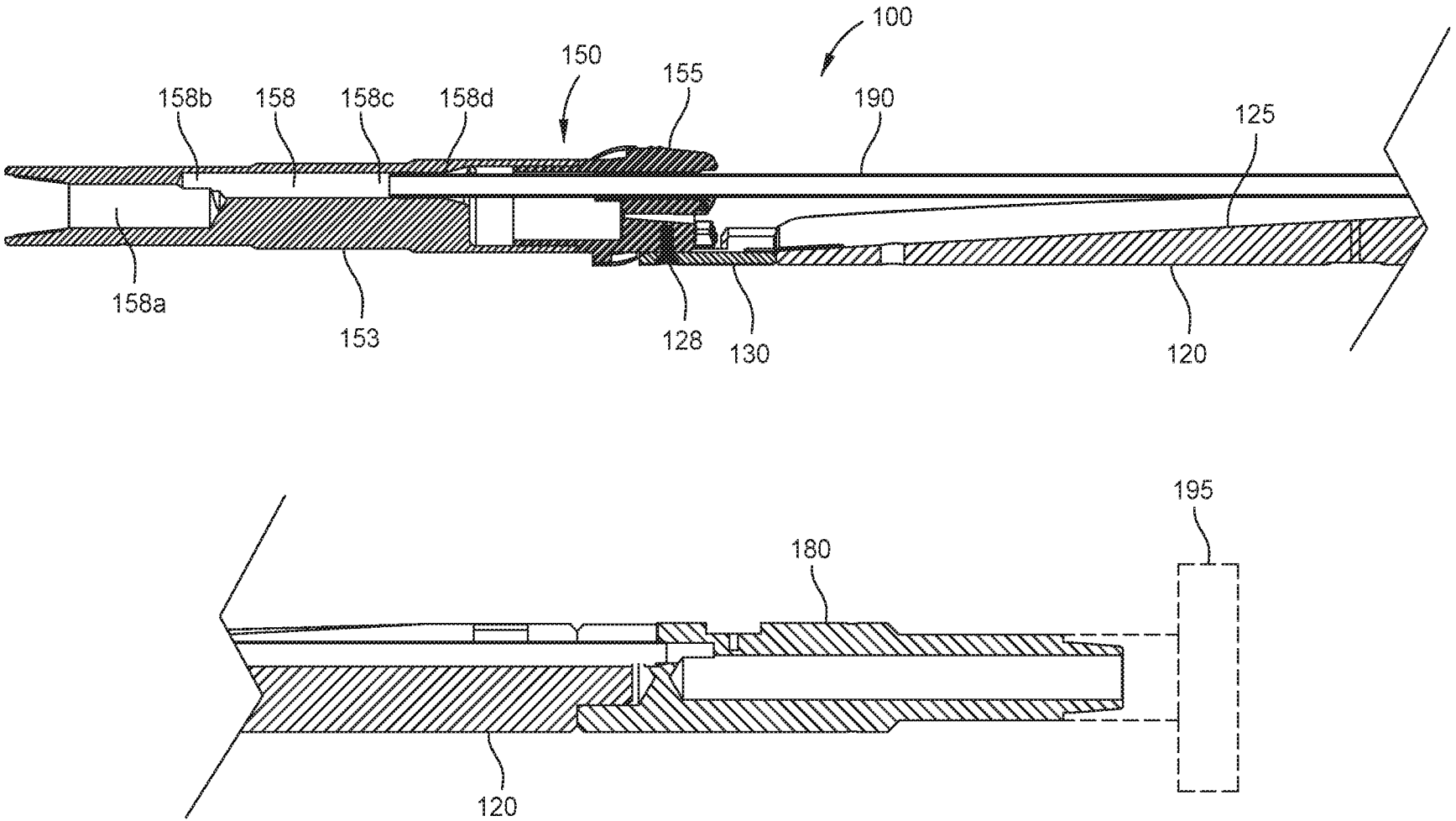
FIG. 2 is a cross-sectional view of the sidetrack assembly of FIG. 1.
Figure 3:
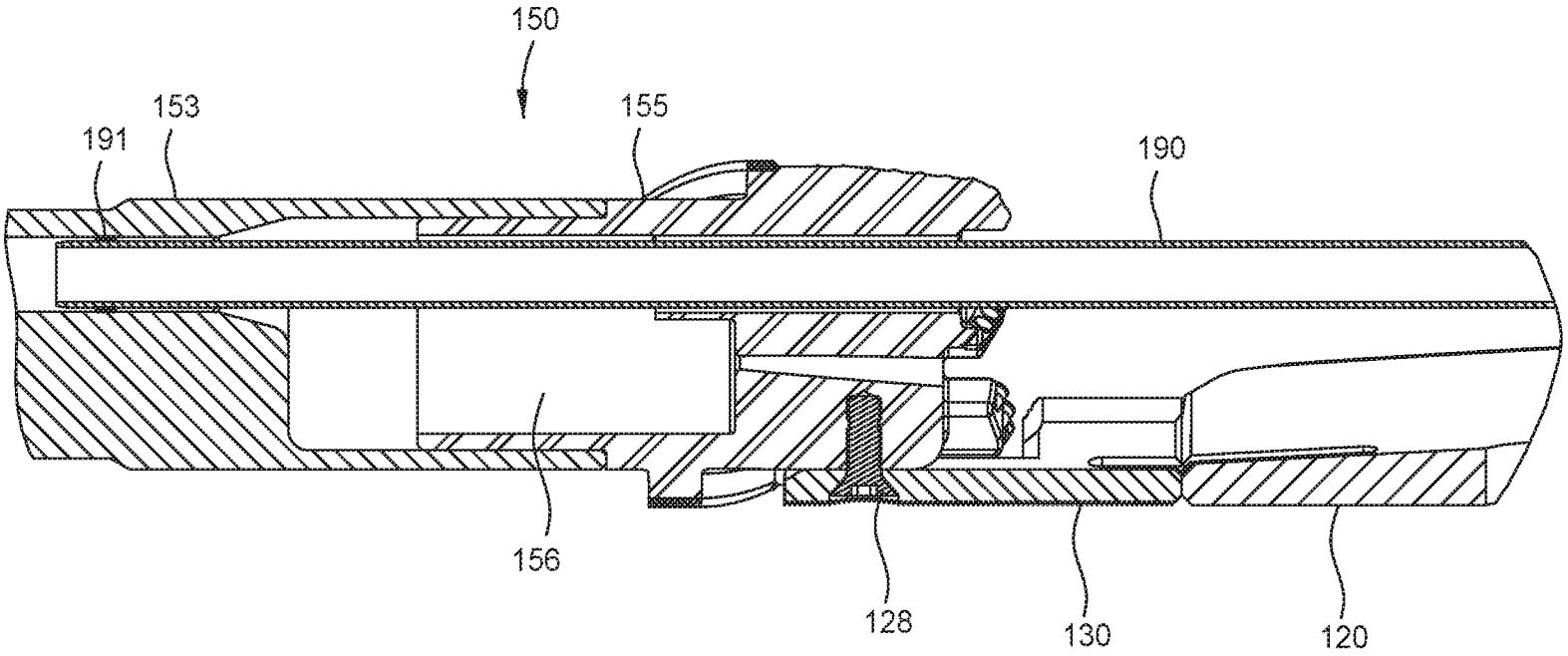
FIG. 3 is an enlarged partial cross-sectional view of the sidetrack assembly of FIG. 2.

FIG. 1 is a perspective view of one embodiment of a sidetrack assembly 100 for supplying cement and forming at least a portion of a lateral wellbore in a parent wellbore. FIG. 2 is a cross-sectional view of the sidetrack assembly 100 of FIG. 1. FIG. 3 is an enlarged partial view of the sidetrack assembly 100 of FIG. 2.

In the illustrated embodiment of FIGS. 1-3, the sidetrack assembly 100 includes a drilling assembly releasably attached to a whipstock 120. In the embodiment shown, the drilling assembly is a mill 150; however, the drilling assembly may also be a drill bit. The mill 150 is attached to the upper end of the whipstock 120. The lower end of the whipstock 120 is attached to an adapter 180 for connection to a downhole tool 195, such as a packer, a fishing tool, and a cement basket. In another embodiment, the adapter 180 is integrated with the whipstock 120. In another embodiment, the adapter 180 is integrated with the downhole tool.

The whipstock 120 includes a concave, inclined surface 125 for guiding the path of the mill 150. In one embodiment, the concave surface 125 at the upper portion of the whipstock 120 is an inclined cut out, as shown in FIGS. 1 and 2. The inclined cut out may be achieved using a concave cut on a wall of the whipstock 120. The inclined cut out may begin at the upper end of the whipstock 120 and may extend toward the lower end. In one embodiment, the inclined cut out formed on the upper portion of the whipstock 120 is used as a concave ramp to guide the movement of the mill 150 and set the mill's angle of attack to form a portion of the lateral wellbore, e.g., to form the pilot borehole. In one embodiment, the inclined cut out may be between about 2 degrees and 15 degrees; preferably between 2 degrees and 8 degrees; and more preferably between about 2 degrees and 5 degrees.

During run-in, the mill 150 is attached to the upper end of the whipstock 120 using a shearable member 128 such as a shear screw, as shown in FIG. 3. The upper end of the whipstock 120 includes an attachment section 130. In one embodiment, the attachment section 130 is attached to the whipstock 120, as shown in FIGS. 1-3. In another embodiment, the attachment section 130 is integrated with the whipstock 120. For example, the attachment section 130 and the whipstock 120 may be formed as a single unit. In some embodiments, the concave, inclined surface 125 of the whipstock 120 begins on at least a portion of the attachment section 130. In some embodiments, the attachment section 130 may be configured to separate from the whipstock 120 and be milled as a consumable piece once the whipstock 120 is in place and the shearable member 128 is sheared.

As can be seen in FIG. 3, the mill 150 includes a body 153 and a mill head 155. The body 153 includes a receiving portion 153*a* that ends at body end 153*b*. The mill head 155 includes an inserting portion 155*a* with a shoulder 155*b* (see FIG. 6). According to an embodiment, the mill head 155 is shrink-fitted to the body 155. For example, the body 153 is heated to expand receiving portion 153*a* and/or the mill head 155 is cooled to contract inserting portion 155*a*. In the state in which the body 153 is sufficiently heated and/or the mill head 155 is sufficiently cooled, the inserting portion 155*a* is inserted into receiving portion 153*a* until the body end 153*b* abuts against shoulder 155*b*. When the body 153 and/or the mill head 155 return to ambient temperature, the receiving portion 153*a* contracts and/or the inserting portion 155*a* expands, so that the two components tightly fit together so as to be capable of withstanding required operating pressures. According to an embodiment, one or more of the receiving portion 153*a* and the inserting portion 155*a* may have a copper plating applied to the surface so as to increase the coefficient of friction.

As described above, the inserting portion 155*a* of the mill head 155 fits inside the receiving portion 153*a* of the body 153. However, other attachment arrangements are contemplated. For example, a portion of the body 153 may be shrink-fitted inside a portion of the mill head 155.

According to an embodiment, the body 153 may have a tongue and the mill head 155 may have a corresponding groove (or vice versa) that cooperate when the body 153 and the mill head 155 are being fit together. The tongue-and-groove arrangement may provide for proper alignment of inlet passage 158*c* and first port 159 (described below). The tongue-and-groove arrangement may also provide for improved two-way torque transmission.

According to an alternate embodiment, the body 153 may have a groove and the mill head may have plug in a drilled hole, or vice versa. The plug may cooperatively fit in the groove when the body 153 and the mill head 155 are being fit together. Similar to the tongue-and-groove arrangement described above, this arrangement may provide for proper alignment of inlet passage 158*c* and first port 159. The plug in the drilled hole may be advantageous due to, for example, low machining cost.

When the mill head 155 needs to be removed for repair, reconditioning and/or replacement, the body 153 can be heated and/or the mill head 155 can be cooled until the two components can be separated. The mill head 155 can then be repaired and/or reconditioned as required. During the repair and/or reconditioning of an out-of-service mill head 155, a replacement mill head 155 can be fitted and attached to the body 153 to minimize interruption to operations. According to an embodiment, an existing mill head 155 may be changed out for a replacement mill head 155 that has cutting and/or milling surfaces that are optimized for conditions of a target formation.

The end of the body 153 may become damaged during operations or removal of the mill head 155. A portion of the receiving portion 153*a* may be cut off after mill head 155 is removed or to facilitate removal of mill head 155. By cutting off a suitable length of the receiving portion 153*a* to remove, for example, a damaged portion of the receiving portion 153*a*, the mill head 155 can be attached to the body 153 on a new, undamaged receiving portion 153*a*.

As described further below, the mill head 155 includes blades 160, which includes first blade segment 161 and second blade segment 162. The second blade segment 162 includes cutting inserts 162*a*. All cutting structures for mill 150 are on the mill head 155, which can be easily removed for reworking and then replaced. That is, the mill head 155 may need to be reworked after a few operation cycles due to wear on the cutting structures. On the other hand, because the cutting structures are on the mill head 155 and not on the body 153, the body 153 may last for thousands of operation hours before needing to be replaced. Even when the receiving portion 153*a* of the body 153 needs to be trimmed after a few operation cycles as described above, for example, the rest of the body 153 can remain in operation.

As described above, in one embodiment, the body 153 and mill head 155 are shrink-fit together to form the mill 150. The shrink-fit connection is well suited for two-way torque transmission. However, any other suitable connection may be utilized for connecting the mill head 155 to the body 153.

For the shrink-fit connection between the body 153 and the mill head 155, it is preferable for the inserting portion 155*a* of the mill head 155 to fit inside the receiving portion 153*a* of the body 153. With such an arrangement, the interface geometry is simple with minimal discontinuity. Additionally, the shrink-fit connection or removal procedure does not require heating the mill head 155 which may damage materials that are brazed on the mill head 155, as will be described below. However, as noted above, the opposite arrangement—that is, a portion of the body 153 fitting within a portion of the mill head 155—is also possible.

Further, as described, the body 153 and mill head 155 are separate components that are attached together, with the mill head 155 being removed and replaced as needed according to operations. However, the mill head 155 may be integrally formed with the body 153 as a single piece.

Figure 4:
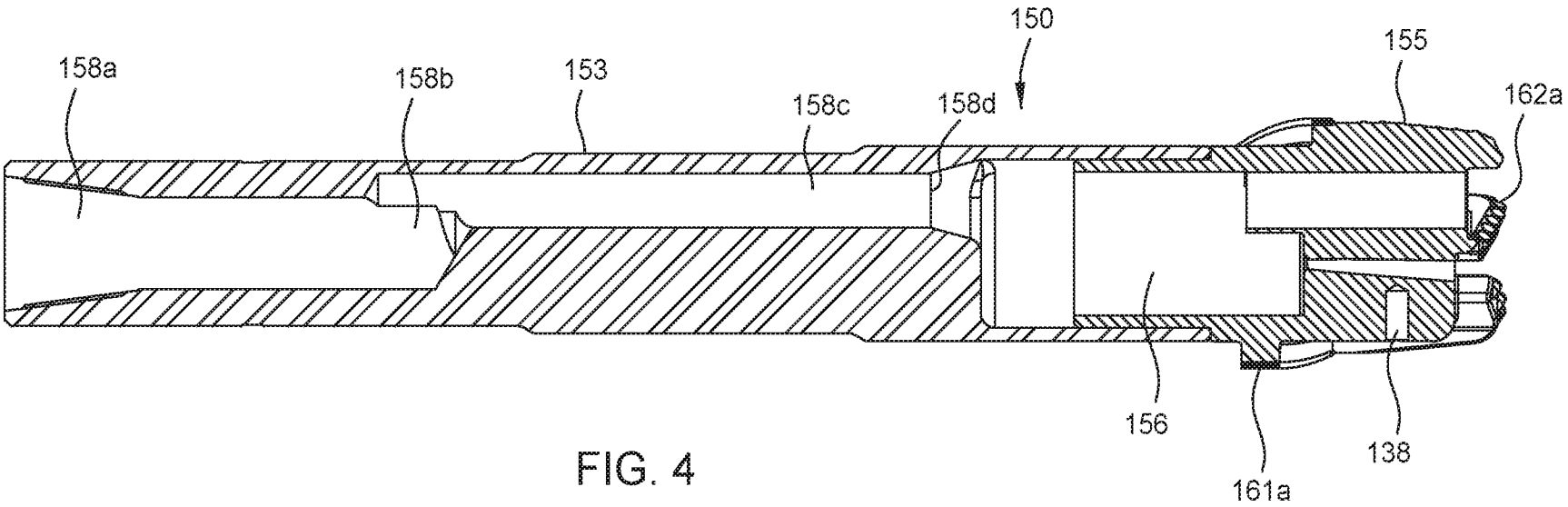
FIG. 4 is a cross-sectional view of an exemplary mill of the sidetrack assembly in accordance with one embodiment.
Figure 5:
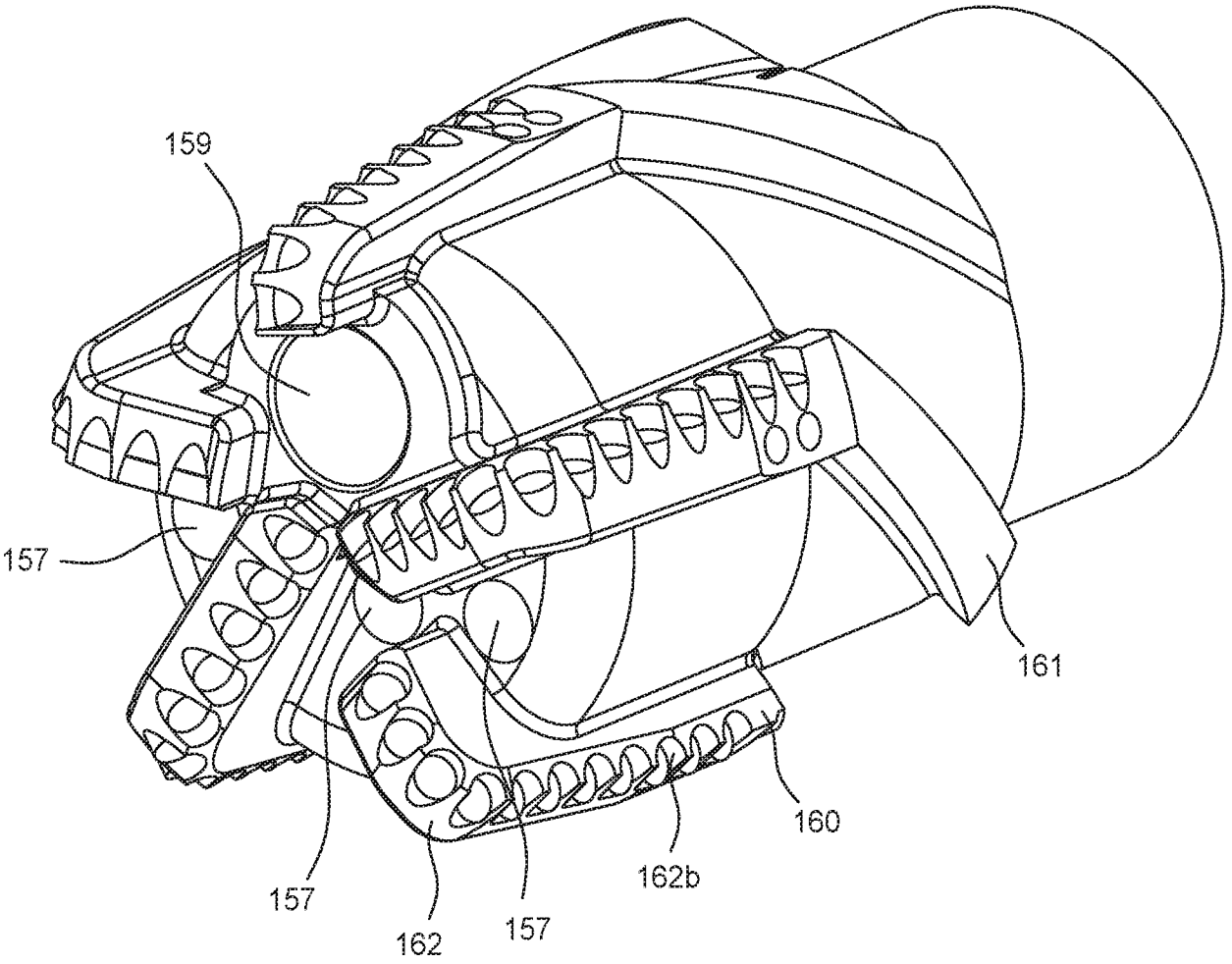
FIG. 5 is a perspective view of a mill head of the mill of FIG. 4.
Figure 6:
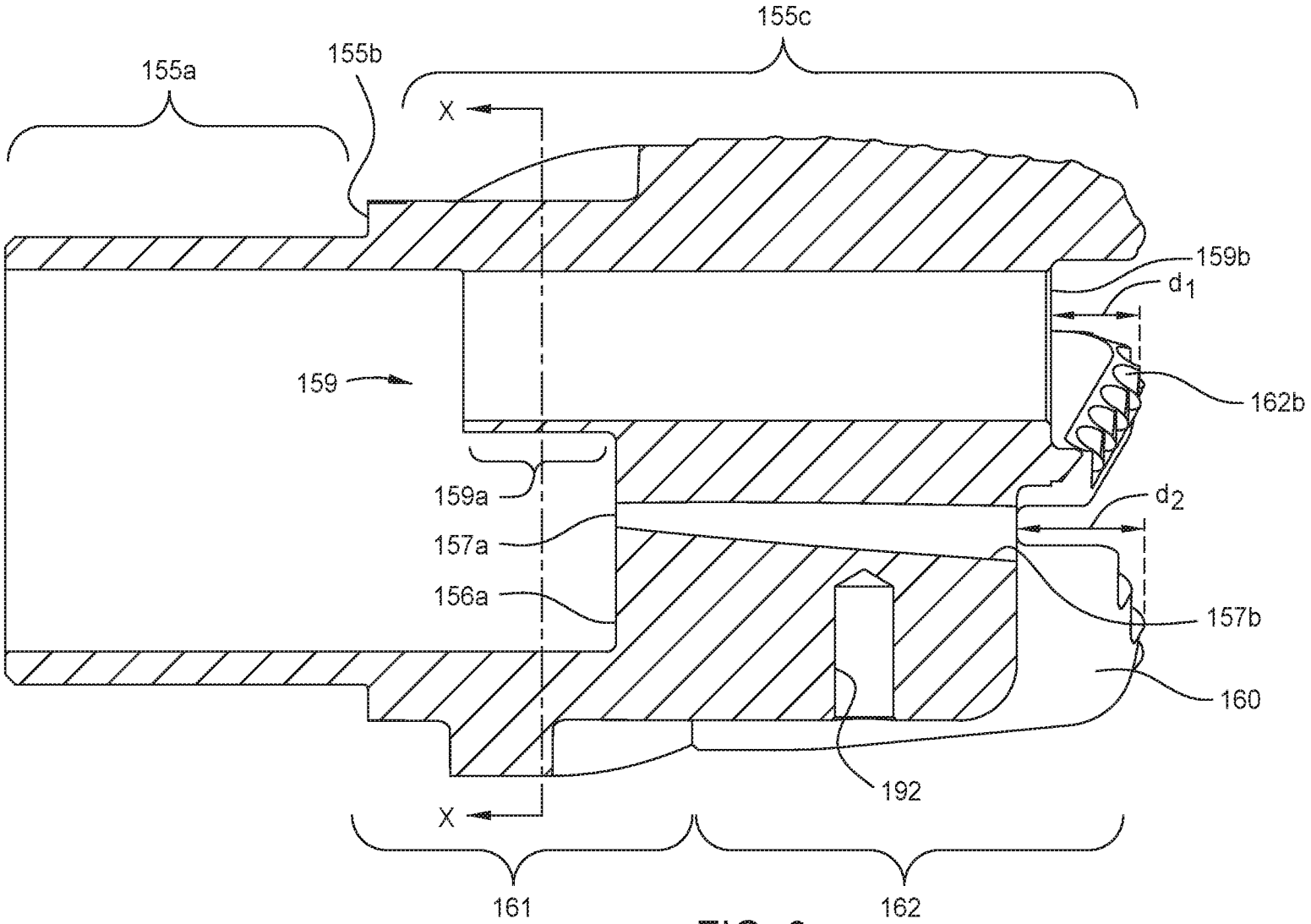
FIG. 6 is a cross-sectional view of the mill head of FIG. 5.
Figure 7:
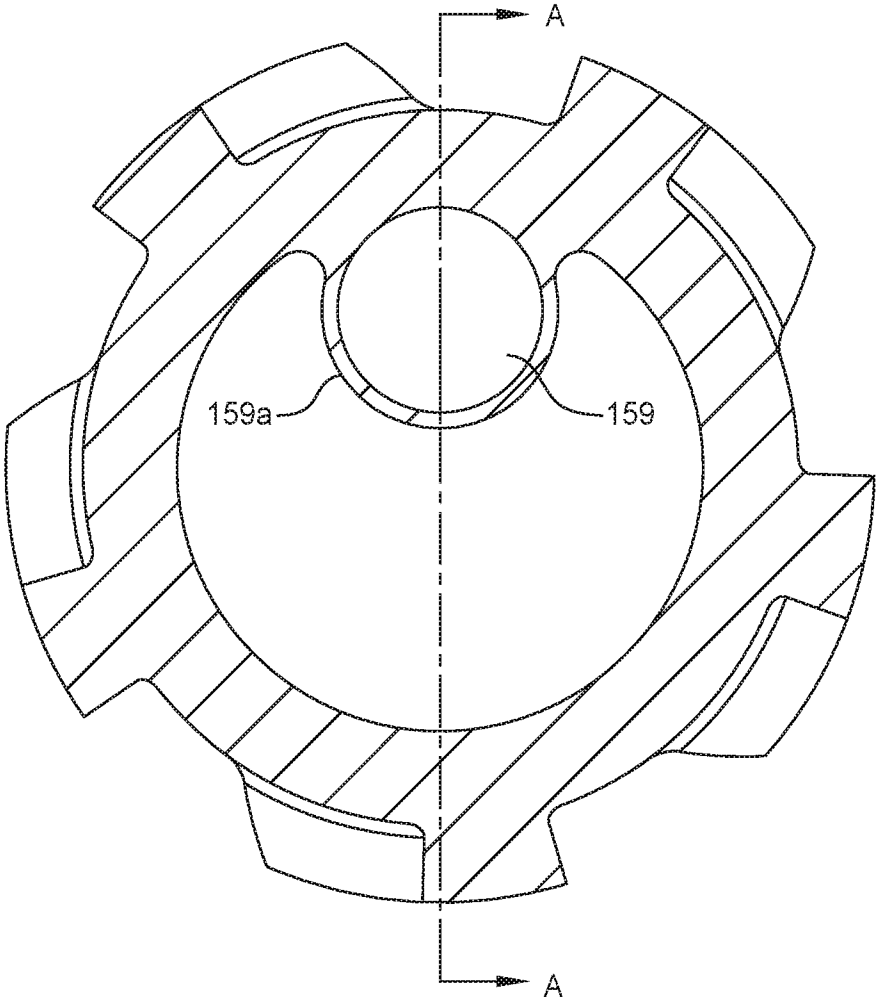
FIG. 7 is another cross-sectional view of the mill head of FIG. 5.

FIG. 4 is a cross-sectional view of the mill 150. FIG. 5 is a perspective view of the mill head 155. FIG. 6 is a cross-sectional view of the mill head 155 along section line A of FIG. 7. FIG. 7 is a cross-sectional view of the mill head along section line X of FIG. 6. As noted above, the mill head 155 includes inserting portion 155*a* and shoulder 155*b*. The mill head also includes blade portion 155*c*. The mill head 155 includes a plurality of blades 160 arranged around extending from a surface of blade portion 155*c*. Each blade 160 includes a first blade segment 161 on a circumferential surface of blade portion 155*c* and a second blade segment 162 extending to a face of blade portion 155*c*. As can be seen in FIG. 4, an exterior surface of the first blade segment 161 is coated with a layer 161*a*. The layer 161*a* may be a tungsten carbide layer. The layer 161*a* may be brazed to the first blade segment 161.

An exterior surface of the second blade segment 162 includes cutting inserts 162*a* (shown in FIGS. 3 and 4) mounted into cutter recesses 162*b* (shown in FIGS. 5 and 6). The cutting inserts 162*a* may be polycrystalline diamond compact (PDC) cutters or carbide plugs. The cutting inserts 162*a* may be brazed to the second blade segment 162. However, other methods may be used to mount the cutting inserts 162*a* to the second blade segment 162. For example, the cutting inserts 162*a* may be press-fit into the cutter recesses 162*b*. For example, the cutting inserts 162*a* may be press-fit and then brazed into the cutter recesses 162*b*. The type of cutting inserts 162*a* are interchangeable and may be selected based on, for example, properties of the target formation. The layer 161*a* and/or the cutting inserts 162*a* may be replaced during rework or repair of the mill head 155. During a sidetrack drilling operation, for example, the second blade segment 162 may contact the target formation to extend the wellbore or form a lateral wellbore off of an existing wellbore.

The first blade segment 161 may serve as bore protection to maintain a diameter of the wellbore being drilled. According to an alternative embodiment (not shown, the cutter recesses 162*b* and corresponding cutting inserts 162*a* may extend along the entire length of the blade 160 of the mill head 155, including along the first blade segment 161. A mill head 155 having the cutting inserts 162*a* along the entire length of the blade 160 may be used, for example, in operations that do not require bore protection.

Preferably, the mill head 155 and blades 160 are generally formed together as a single piece, with replaceable materials such as the layer 161*a* and the cutting inserts 162*a* affixed to the blades 160.

A bore 158 extends through the body 153. The bore 158 may include an inlet passage 158*a*, an angled passage 158*b*, and an outlet passage 158*c*. The angled portion 158*b* fluidly connects the inlet passage 158*a* to the outlet passage 158*c*. The central axis of the outlet passage 158*c* is located above the central axis of the inlet passage 158*a*. The angled passage 158*b* may be angled between 1 degree and 8 degrees. In one example, the angled passage 158*b* has an inner diameter that is larger than the inner diameter of the outlet passage 158*c*. The bore 158 also includes body port 158*d*. The body port 158*d* fluidly connects the bore 158 to pressure chamber 156, described below.

As depicted, the outlet passage 158*c* is offset from a central axis of the body 153. Other configurations are possible. For example, the entire bore 158 may be straight so that the central axis of the bore 158 from the inlet to the outlet at body port 158*d* is aligned along the central axis of the body.

The mill head 155 includes a first port 159 and a second port 157. The diameter of the first port 159 is substantially the same as the diameter of the body port 158*d*. The central axis of the first port 159 corresponds to the central axis of the body port 158*d*. In the illustrated embodiment, the mill head 155 includes three second ports 157. Each second port 157 is positioned and angled to clean and cool a cutting face of the second blade segment 162 and the cutting inserts 162*a*. That is, the placement and angle of the second ports 157 is optimized for effectively cleaning and cooling the cutting inserts 162*a*. For example the second ports 157 are aimed towards the cutting inserts 162*a* as well as towards an outer diameter of the mill head 155. Thus, fluid such as drilling mud can flow out of the second ports 157 under pressure to dislodge and circulate debris away from the blades 160 and the cutting inserts 162*a* on the mill head 155.

A finger 133 extends above a top surface of the attachment section 130. In other embodiments, a plurality of fingers may be formed above the top surface of the attachment section 130. The finger 133 fits between two blades 160 of the mill 150. A hole 138 is formed through the attachment section 130 to receive the shearable member 128. A tapped hole 192 (see FIG. 6) is formed in the mill head 155 for engaging the shearable member 128.

The mill head 155 may be equipped with two or more blades 160, such as two, four, five, six, and eight blades. According to an embodiment, the mill head 155 includes five blades 160 arranged circumferentially on the mill 150. The ends of each of the blades 160 are disposed at various positions on the face of the mill head 155 to accommodate the positions of the first port 159 and second ports 157. The finger 133 on the attachment section 130 fits between two blades 160 of the mill head 155. The finger 133 and the shearable member 128 hold the weight of the whipstock 120 as the sidetrack assembly 100 is lowered into a borehole for operations (described below)

In one embodiment, the sidetrack assembly 100 includes a flow path for supplying cement from the mill 150 to the wellbore below the whipstock 120. Referring to FIGS. 1 and 2, a tubing 190 is disposed in the whipstock 120. The tubing 190 is preferentially copper tubing, although any suitable tubing material may be used. The lower end of the tubing 190 extends out of the whipstock 120 and is connectable with the adapter 180. The tubing 190 fluid communicates with the central passage of the adapter 180. The adapter 180 may be attached to a downhole tool 195, thereby placing the tubing 190 in fluid communication with the downhole tool 195. In one embodiment, the downhole tool 195 is packer, anchor, or a combination of packer and anchor assembly. For example, the anchor may include a plurality of slips disposed on a mandrel having a bore. The packer may include a sealing element disposed on a mandrel having a bore. An exemplary packer is an inflatable packer.

The upper end of the tubing 190 extends out of the whipstock 120 and is connectable with the first port 159 of the mill head 155 and the outlet passage 158*c*. A sealing member 191 on the tubing 190 provides a sealed connection between an exterior surface of the tubing 190 and the interior surface of the outlet passage 158*c*. The sealing member 191 is preferably a bonded seal. Alternatively, any suitable sealing member, such as an O-ring, may be used for sealing member 191. In the embodiment, one sealing member 191 is shown. However, two or more sealing members 191 may be used. In some embodiments, a groove is provided on the tubing 190 to seat the sealing member 191 in place. According to one embodiment, the sealing member 191 is seated on an interior surface of the outlet passage 158*c*. Alternatively, the sealing member 191 may be seated on an exterior surface of the tubing 190.

During installation, the upper end of the tubing 190 is inserted into the first port 159 and the body port 158*d*. The sealing member 191 provide a seal between the exterior surface of the tubing 190 and the interior surface of the outlet passage 158*c* to prevent leakage. In one embodiment, the section of the tubing 190 inserted into the body port 158*d* (and the outlet passage 158*c*) is from 2 in. to 36 in., from about 3 in. to 24 in., or from about 6 in. to 18 in.

During assembly, the mill 150 is releasably attached to the whipstock 120 via the attachment section 130. That is, the tubing 190 is inserted into the first port 159 and the body port 158*d*, and the finger 133 of the attachment section 130 is positioned between two blades 160. The shearable screw 128 is inserted through the hole 138 of the attachment section 130 and the tapped hole 192 of the mill 150 to releasably attach the mill 150 to the whipstock 120.

In operation, a downhole tool 195, such as a packer, is attached to the whipstock 120. The mill 150 and the whipstock 120 are lowered into the wellbore using a work string. In this example, the wellbore is an open hole wellbore. Alternatively, this operation may be performed in a cased wellbore. After reaching the location of the pilot borehole to be formed, the packer is set below the location of the pilot borehole. In one embodiment, the inclined surface 125 of whipstock 120 is oriented to the appropriate azimuth in the borehole to guide the path of the mill 150. The wellbore below the packer is isolated from the whipstock 120. Cement is supplied through the work string, the bore 158 of the mill 150, the tubing 190, and the passage of the adapter 180. The cement exits below the packer and into the wellbore. In another embodiment, cement is supplied below the packer before setting the packer. In yet another embodiment, the cement is located above and below the packer. For example, an actuating device, such as a ball or a dart, is dropped into the work string. The actuating device travels through the bore 158 of the mill 150, the tubing 190, and lands in the downhole tool 195, such as a packer or an anchor, attached to the whipstock 120. Pressure is increased to cause the ball to shift a sleeve in the downhole tool 195, thereby opening a port in the downhole tool 195. Fluid can be supplied through the port to actuate the downhole tool 195. Exemplary fluids include cement, drilling fluid such as a drilling mud, and completion fluid such as brine. In some embodiments, the downhole tool includes a one way valve such as a check valve (for example, a DSV® check valve) _that prevents the fluid from reverse flowing back into the downhole tool 195. If the downhole tool 195 is a packer, the fluid can be used to inflate the packer. In some embodiments, fluid flow through the downhole tool 195 is re-established by increasing pressure to release the ball from the sleeve.

The receiving portion 153*a* of the body 153 and the inserting portion 155*a* of the mill head 155 form the pressure chamber 156. As noted above, the reverse arrangement between the body 153 and the mill head 155 is also contemplated, in which case the inserting portion of the body 153 and the receiving portion of the mill head 155 form the pressure chamber 156. The pressure chamber 156 has sufficient size so as to receive fluid from bore 158 via body port 158*d* and accumulate pressure to supply the fluid to each of the second ports 157 at the same time and at pressure sufficient for the desired operation, such as cleaning and cooling the blades 160 and the cutting inserts 162*a* during a sidetrack drilling operation.

When the tubing 190 is positioned in the first port 159 and the body port 158*d*, the pressure chamber 156 and the second ports 157 are isolated from the body port 158*d*. In other words, when the tubing 190 is positioned in the first port 159 and the body port 158*d*, fluid entering inlet passage 158*a* is directed through the tubing 190 to the downhole tool 195 while bypassing the pressure chamber 156 and the second ports 157. To release the mill 150, a tension force is applied to the mill 150 by pulling up on the mill 150 via the work string. A sufficient force is applied to break the shear screw 128. After the shear screw 128 is broken, the mill 150 can be pulled away from the whipstock 120.

Pulling the mill 150 away from the whipstock 120 also positions the tubing 190 relative to the body port 158*d* and the first port 159. That is, as the mill 150 is pulled away from the whipstock 120, the tubing 190 is first pulled out of the body port 158*d* and then pulled out of first port 159 so that the mill 150 becomes completely separated from the whipstock 120.

Thus, the tubing 190 has at least three positions relative to the mill 150. As discussed above, in the first position, the tubing 190 is positioned within the first port 159 and the body port 158*d*. In this first position, the pressure chamber 156 and the second ports 157 are isolated from the body port 158*d*. Thus, when the tubing 190 is positioned in the first port 159 and the outlet passage 158*c*, fluid entering inlet passage 158*a* is directed through the tubing 190 to the downhole tool 195 while bypassing the pressure chamber 156 and the second ports 157. The first position is used for, for example, setting the packer below the whipstock 120, as described above, or for operating a different downhole tool 195. Also, the full sidetrack assembly 100 (that is, the whipstock 120 and the mill 150 connected together by the attachment section 130) is lowered into the borehole while the tubing 190 is in the first position.

In the second position, the mill 150 is pulled a small distance away from the whipstock 120 so that the tubing 190 is positioned within the first port 159, but not in the body port 158*d*. In this second position, the pressure chamber 156 and the second ports 157 are in communication with the body port 158*d*. Additionally, the tubing 190 and, by extension, the downhole tool 195 are in communication with the body port 158*d*. Thus, fluid entering inlet passage 158*a* is directed into the pressure chamber 156, second ports 157, and also through the tubing 190 to the downhole tool 195. In some embodiments, one or more of the second ports 157 may be connected to another tool. Thus, the second position can be used to operate the downhole tool 195 via tubing 190 as well as another tool via a second port 157.

In the third position, the mill 150 is pulled completely away from the whipstock 120 so that the tubing 190 is separated from the mill 150.

Once the mill 150 is completely separated from the tubing 190, the mill 150 can be then urged along the whipstock 120, which deflects the mill 150 outward into engagement with the wellbore. The tubing 190 may be milled as a consumable as the mill 150 travels along the whipstock 120. Also, as noted above, attachment section 130 may be milled as a consumable as the mill 150 travels along the whipstock 120. The mill 150 may then be operated to form at least a portion of the lateral wellbore. Thereafter, the mill 150 is retrieved. In this manner, supplying cement through the whipstock and forming at least a portion of the lateral wellbore can be achieved in a single trip. In some instances, a drill bit is lowered into the wellbore in a second trip and operated to extend the lateral wellbore.

As can be seen in FIG. 5, the first port 159 has a larger diameter than that of the second ports 157. According to an alternate embodiment, the first port 159 may have the same diameter as that of the second ports 157. With the first port 159 and the second ports 157 having the same diameter, the first port 159 can perform the same function as the second ports 157, i.e., cleaning the cutting surfaces on the face of mill head 155.

According to an embodiment, flow direction in the mill head 155 is optimized by controlling head loss and flow velocity. Once the tube 190 is removed from the mill head 155, flow communicates from the body port 158*d* to the pressure chamber 156. The body port 158*d* exit is designed to minimize head loss and turbulence during expansion of the fluid entering the pressure chamber 156. The flow cross-sectional area of the pressure chamber 156 is significantly larger than the flow cross-sectional area of the body port 158*d*. This increase in flow cross-sectional area reduces the flow velocity, and the reduced flow velocity increases pressure inside the pressure chamber 156. Without flow redirection, the majority of the fluid flow from the body port 158 would be directed straight through the first port 159 while "starving" the second ports 157. Accordingly, features to increase head loss at the first port 159 are employed to counteract this natural flow tendency.

For example, according to an embodiment, the first port 159 includes an entrance and exit having high minor head loss coefficients K. In particular, the entrance of the first port 159 includes a re-entrant 159*a*. Re-entrant 159*a* is a tubular entrance that extends away from inner face surface 156*a* of the pressure chamber 156. The re-entrant 159*a* forces the flow to circle around the walls of the re-entrant 159*a* to find the entrance to the first port 159. Ideally, the re-entrant has a K value of at least 0.78. The head loss is determined according to the formula:

$$\text{Head Loss}=K\times(V_{average}^{2}/2).$$

This head loss at the first port 159 increases pressure seen by the second ports 157.

Exit 159*b* of first port 159 on the face of the mill head 155 has squared-off edges. Additionally, exit 159*b* is located a small distance $d_1$ to the cutting surfaces of the face of the mill head 155, i.e., second blade segments 162. Thus, during milling operations, the exit 159*b* is close to the formation being milled. This close proximity to the formation being milled creates a back pressure that further increases the pressure inside the pressure chamber 156.

As described above, the features of the first port 159 are designed to increase head loss and restrict flow. On the other hand, the features of the secondary ports 157 are designed to reduce head loss and promote high flow velocity. For example, according to an embodiment, the second ports 157 each include an entrance 157*a* that is smooth and rounded, as opposed to squared off. The second ports 157 may also each include an exit 157*b* located a distance $d_2$ from the cutting surfaces of the face of the mill head 155 that is larger than $d_1$.

The combination of head loss and pressure increase features described above redirects flow from the first port 159 to the second ports 157, thus ensuring that the second ports 157 receive a substantial portion of the flow. Thus, the second ports 157 still have sufficient pressure for cleaning the cutting surfaces on the face of the mill head 155 even with the first port 159 open to fluid flow. Preferably, all second ports 157 have the same diameter to ensure equal flow between the second ports 157. The diameter of the second ports 157 may be smaller than the first port 159. The sum of the flow areas of the second ports 157 may be approximately the same as the flow area of the first port 159 to ensure equal flow between the first port 159 and the second ports 157.

During milling operations, the pressure chamber 156 and second ports 157 are subject to a high pressure flow of drilling mud. Accordingly, the entrance to the second ports 157 inside the pressure chamber 156 may be susceptible to erosion. To prevent erosion, the second ports 157 may be reinforced. Alternatively, ceramic projections may be provided at the entrance 157*a* of the second ports 157 to introduce localized turbulence to the fluid flow entering the second ports 157.

In one embodiment, the exit 157*b* of the second ports 157 may be threaded so that nozzles can be fitted to the exit 157*b* of the second ports 157.

Figure 8:
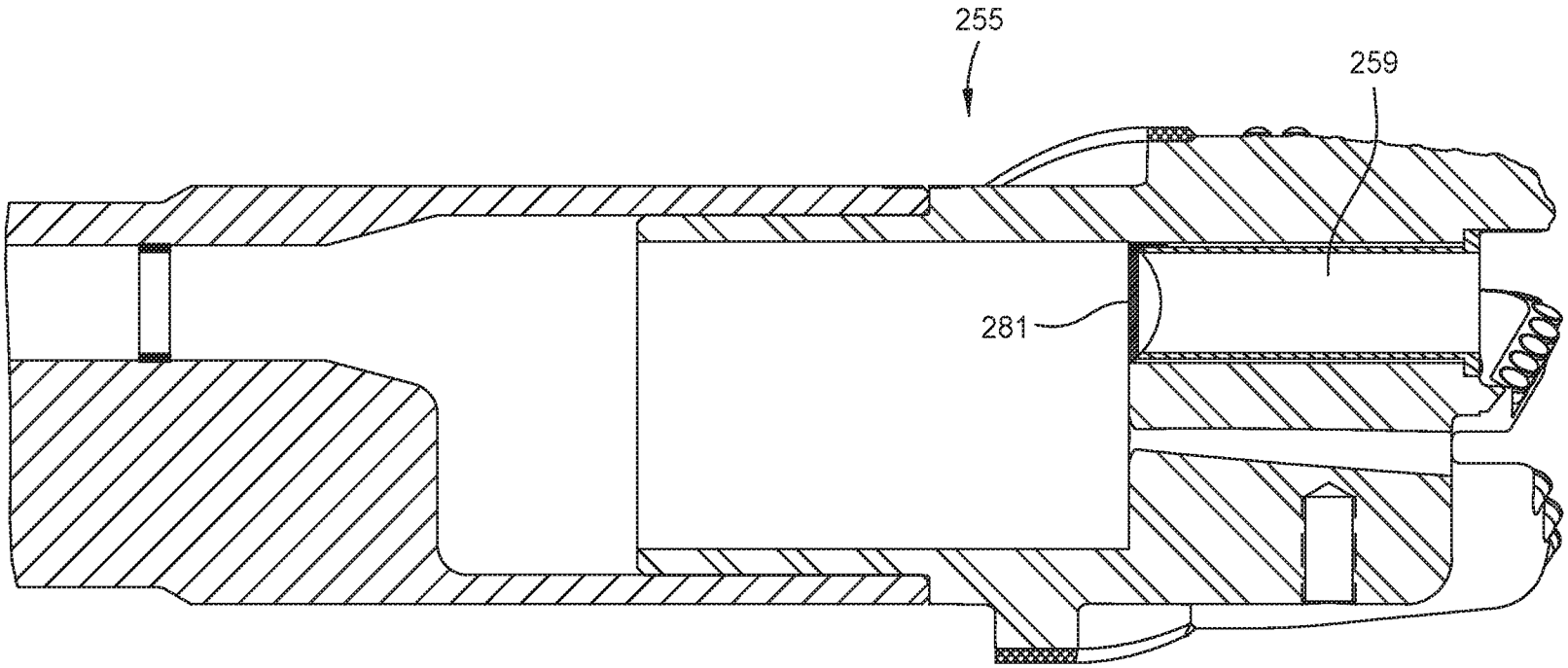
FIGS. 8 and 9 are cross-sectional views of alternative embodiment of a mill head.
Figure 9:
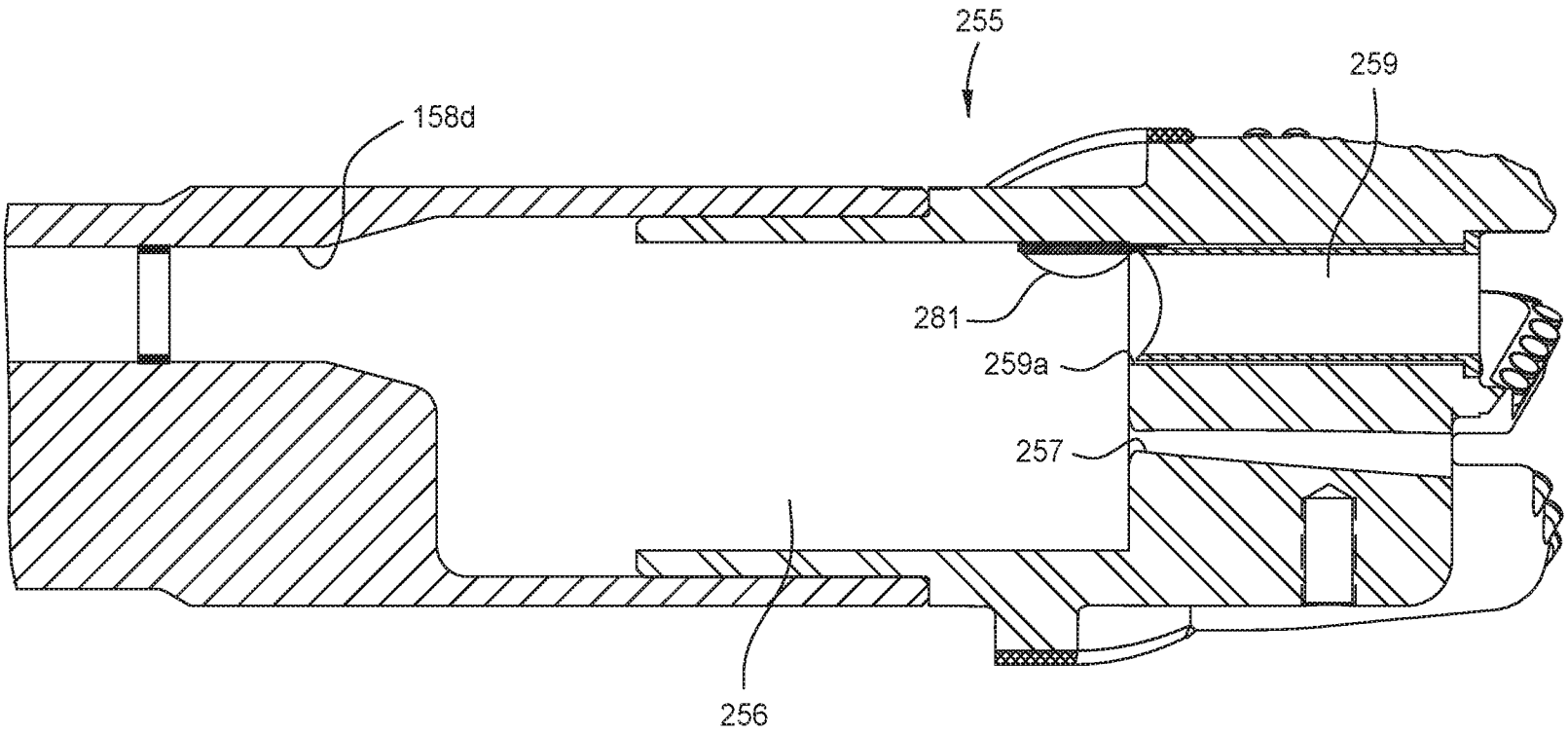

FIGS. 8 and 9 illustrates a cross-sectional view of an alternative embodiment of a mill head 255. Structures having configurations similar to those described above have the same reference numbers and description thereof is omitted. According to the alternative embodiment, the mill head 255 differs from the mill head 155 in that the valve 281 is included to selectively close entrance 259*a* of first port 259.

The valve 281 closes first port 259 when the tubing 190 is removed. FIG. 8 illustrates valve 281 in a closed position. FIG. 9 illustrates valve 281 in an open position. Although tubing 190 is omitted in FIG. 9 for clarity, the tubing 190 is typically in place in first port 259 to hold the valve 281 in the open position. According to one embodiment, the valve 281 may be a flapper valve. Alternatively, the valve 281 may also be a diaphragm, or any suitable mechanism that closes first port 259 when the tubing 190 is removed. The valve 281 may be threaded onto entrance 259*a* of the first port 259 via threads on the first port 259; alternatively, the valve 281 may be attached to the first port 259 according to known methods.

In the third position of the mill head 255 relative to the tubing 190 described above, pressure chamber 256 and second ports 257 are in fluid communication with the body port 158*d*. Additionally, when the valve 281 closes after the tubing 190 is removed from the body port 158*d*, the first port 259, and the mill head 255, the first port 259 is isolated from the body port 158*d*. Thus, fluid from inlet passage 158*a* exits body port 158*d* and is directed into the pressure chamber 256 and through the second ports 257, but not through the first port 259. Thus, the third position can be used to clean the cutting surfaces of the mill head 255 during milling operations, such as, for example, sidetrack drilling.

Figure 10:
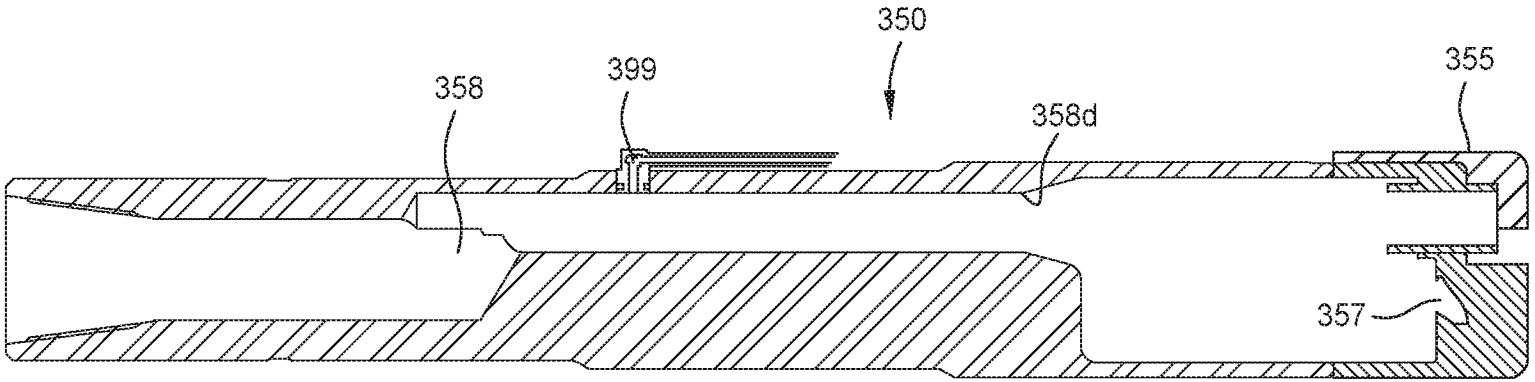
FIG. 10 is a cross-sectional view of a control system according to an another embodiment.

FIG. 10 illustrates a cross-sectional view of a mill 350 according to another embodiment. Structures having configurations similar to those described above have the same reference numbers and description thereof is omitted. In this embodiment, mill 350 includes body 353 and mill head 355. Similar to the embodiments described above, the body 353 includes bore 358 through which fluid is provided to mill head 355.

One or more auxiliary control ports 399 extend from bore 358. In FIG. 10, only one auxiliary control port 399 is shown, although any number of auxiliary control ports 399 may be included. Similar to the above description, one end of tubing 190 can be removably positioned through first port 359 and body port 358*d* in bore 358, with a sealed connection between an exterior surface of one end of the tubing 190 and the interior surface of the bore 358. The opposite end of the tubing 190 may be operably connected to a whipstock, a packer or another downhole tool. The auxiliary control port 399 may also be operably connected to other downhole tools. However, the auxiliary control port 399 is not necessarily connected to other downhole tools. That is, the auxiliary control port 399 may simply provide a fluid conduit to any downhole location that requires fluid according to a desired operation.

The tubing 190 can have various positions relative to mill 350. That is, the mill 350 can be selectively pulled a specific distance so that tubing 190 is withdrawn from bore 358 to expose the auxiliary control port 399. In a first position, the tubing 190 is positioned within the body port 358*d* past the auxiliary control port 399. In the first position, the auxiliary control port 399 is isolated from bore 158, and fluid entering the bore 158 is directed through the tubing 190 while bypassing the auxiliary control port 399. Thus, in the first position, fluid is provided only to the downhole tool that is operably connected to the opposite end of the tubing 190.

In a second position, the tubing 190 is withdrawn a small distance out of the bore 358 so that the auxiliary control port 399 is in fluid communication with the bore 358. Fluid entering the bore 358 is directed through auxiliary control port and the tubing 190, but not the second ports 357. Thus, in the second position, fluid is provided to the downhole tools that are operatively connected to the auxiliary control port 399 and the tubing 190.

If multiple auxiliary control ports 399 extend from bore 358, each subsequent position of the tubing 190 relative to the mill 350 sequentially exposes another of the auxiliary control ports 399. Thus, mill 350 and the tubing 190 function together as a sequential valve system that allows selective operation of a plurality of tools, or, more generally, selectively providing fluid to a plurality of downhole locations.

In one embodiment, a cutting device includes a body having a passage and a mill head configured to connect to the body so that an interior of the mill head and the body form a pressure chamber in fluid communication with the passage. The mill head includes a first port having a central axis aligned with a central axis of the outlet passage and in fluid communication with the pressure chamber, a second port in fluid communication with the pressure chamber, and a blade arranged on a face of the mill head.

In another embodiment described herein, a sidetrack assembly for forming a lateral wellbore, includes a cutting device having a body having a passage, and a mill head configured to connect to the body so that an interior of the mill head and the body form a pressure chamber in fluid communication with the outlet passage. The mill head includes a first port having a central axis aligned with a central axis of the outlet passage and in fluid communication with the pressure chamber, a second port in fluid communication with the pressure chamber, and at least one blade arranged on a face of the mill head. A whipstock is removably connected to the cutting device. The whipstock includes a tubing having a first end removably inserted in the first port and the passage and a second end connectable to a downhole tool, an inclined surface for guiding the mill at a non-zero angle relative to a central axis of an existing wellbore, and an attachment section providing a removable connection between the cutting device and the whipstock.

In one or more of the embodiments described herein, the first port and the passage are configured to removably receive a tubing provided on a whipstock, and when the tubing is inserted in the first port and the passage, fluid supplied from the passage flows through the tubing and bypasses the pressure chamber and the second port.

In one or more of the embodiments described herein, a device closes the first port when the tubing is not inserted in the first port.

In one or more of the embodiments described herein, when the tubing is not inserted in the first port and the passage, fluid from the passage flows through the pressure chamber and the second port.

In one or more of the embodiments described herein, the first port includes a re-entrant.

In one or more of the embodiments described herein, when the tubing is not inserted in the first port and the passage, fluid from the passage flows through the pressure chamber, the first port, and the second port.

[ono] In one or more of the embodiments described herein, the mill head includes one of an inserting portion and a receiving portion, the body includes the other of the inserting portion and the receiving portion, and the inserting portion fits inside the receiving portion.

In one or more of the embodiments described herein, the mill head is connected to the body via one of a shrink-fit connection, a welded connection, and a threaded connection.

In one or more of the embodiments described herein, a plurality of cutting inserts are each respectively mounted into a corresponding one of a plurality of cutter recesses formed in the at least one blade.

In one or more of the embodiments described herein, an exit of the first port is a first distance to a cutting surface of the blade, and an exit of the second port is a second distance to a cutting surface of the blade, the second distance being greater than the first distance.

In one or more of the embodiments described herein, an entrance to the second port is rounded.

In one or more of the embodiments described herein, an entrance to the first port is squared.

In one or more of the embodiments described herein, the second port comprises a plurality of second ports, and a sum of flow areas of the second ports is substantially the same as a flow area of the first port.

In another embodiment, a control system for controlling downhole operations includes a body having a passage, a tubing movably positioned in the passage and in fluid communication with the passage, and an auxiliary port extending from the passage. The tubing is moveable between a first position and a second position relative to the passage. In the first position, the auxiliary port is isolated from the passage so that fluid entering the passage bypasses the auxiliary port and is directed through the tubing to a first downhole location for a first desired operation. In the second position, the auxiliary port is in fluid communication with the passage so that fluid entering the passage is directed through the tubing to the first downhole location for the first desired operation and through the auxiliary port to a second downhole location for a second desired operation.

In one or more of the embodiments described herein, a sealed interface is between an exterior surface of the tubing and an interior surface of the passage.

While the foregoing is directed to embodiments of the present disclosure, other and further embodiments of the disclosure may be devised without departing from the basic scope thereof, and the scope thereof is determined by the claims that follow.

The invention claimed is:

1. A cutting device comprising:
- a body having a passage; and
- a mill head configured to connect to the body so that an interior of the mill head and the body form a pressure chamber in fluid communication with the passage, the mill head including:
  - a first port having a central axis aligned with a central axis of the passage and in fluid communication with the pressure chamber,
  - a second port in fluid communication with the pressure chamber, and
  - a blade arranged on a face of the mill head,
- wherein the first port and the passage are configured to removably receive a tubing.

2. The cutting device according to claim 1, wherein
- when the tubing is inserted in the first port and the passage, fluid supplied from the passage flows through the tubing and bypasses the pressure chamber and the second port.

3. The cutting device according to claim 2, further comprising a device that closes the first port when the tubing is not inserted in the first port.

4. The cutting device according to claim 3, wherein the device is a flapper valve.

5. The cutting device according to claim 2, wherein, when the tubing is not inserted in the first port and the passage, fluid from the passage flows through the pressure chamber and the second port.

6. The cutting device according to claim 2, wherein the first port includes a re-entrant.

7. The cutting device according to claim 6, wherein, when the tubing is not inserted in the first port and the passage, fluid from the passage flows through the pressure chamber, the first port, and the second port.

8. The cutting device of claim 2, wherein the tubing is provided on a whipstock.

9. The cutting device according to claim 1, wherein the mill head includes one of an inserting portion and a receiving portion, the body includes the other of the inserting portion and the receiving portion, and the inserting portion fits inside the receiving portion.

10. The cutting device according to claim 1, further comprising a plurality of cutting inserts that are each respectively mounted into a corresponding one of a plurality of cutter recesses formed in the at least one blade.

11. The cutting device according to claim 1, wherein:
- an exit of the first port is a first distance to a cutting surface of the blade, and
- an exit of the second port is a second distance to a cutting surface of the blade, the second distance being greater than the first distance.

12. The cutting device according to claim 1, wherein an entrance to the second port is rounded.

13. The cutting device according to claim 12, wherein an entrance to the first port is squared.

14. The cutting device according to claim 1, wherein:
- the second port comprises a plurality of second ports, and
- a sum of flow areas of the second ports is substantially the same as a flow area of the first port.

15. The cutting device according to claim 1, wherein the first port has a diameter greater than a diameter of the second port.

16. The cutting device according to claim 1, wherein the body further comprises a body port in fluid communication with the passage and the pressure chamber and configured to removably receive the tubing.

17. A cutting device comprising:
- a body having a passage;
- a mill head connected to the body and having a central axis; and
- a pressure chamber formed in an interior of the mill head and the body and configured to receive fluid from the passage;
- wherein the mill head includes:
  - a first outlet port in fluid communication with the pressure chamber, the first outlet port having a central axis aligned with a central axis of the passage and the central axis of the passage is offset from the central axis of the mill head;
  - a second outlet port in fluid communication with the pressure chamber; and
  - a blade arranged on a face of the mill head.

18. The cutting device of claim 17, wherein the passage comprises an outlet passage, and the body further comprises:
- an inlet passage having a central axis and positioned upstream of the outlet passage; and
- a body port positioned downstream of the outlet passage and in fluid communication with the outlet passage.

19. The cutting device of claim 18, wherein the central axis of the outlet passage and the central axis of the first port are offset from the central axis of the inlet passage.

20. The cutting device of claim 18, wherein the body port fluidly connects the bore to the pressure chamber.

* * * * *